US008678367B2

(12) United States Patent
Shimakawa et al.

(10) Patent No.: US 8,678,367 B2
(45) Date of Patent: Mar. 25, 2014

(54) DEVICE FOR ALIGNING PUNCHED SHEETS

(75) Inventors: Yasunori Shimakawa, Komae (JP); Kenichi Watanabe, Mito (JP)

(73) Assignee: Canon Finetech, Misato-shi (JP)

( * ) Notice: Subject to any disclaimer, the term of this patent is extended or adjusted under 35 U.S.C. 154(b) by 42 days.

(21) Appl. No.: 13/301,138

(22) Filed: Nov. 21, 2011

(65) Prior Publication Data

US 2012/0126477 A1 May 24, 2012

(30) Foreign Application Priority Data

Nov. 24, 2010 (JP) ..... 2010-261074

(51) Int. Cl.
*B65H 31/00* (2006.01)

(52) U.S. Cl.
USPC ..... 270/58.09; 270/58.07

(58) Field of Classification Search
USPC ..... 270/58.07, 58.08, 58.09, 58.14, 58.16
See application file for complete search history.

(56) References Cited

U.S. PATENT DOCUMENTS

| | | | | |
|---|---|---|---|---|
| 4,073,391 | A * | 2/1978 | O'Brien et al. | 414/789 |
| 5,240,242 | A | 8/1993 | Ando et al. | |
| 5,599,008 | A * | 2/1997 | Yamashita et al. | 270/58.16 |
| 6,102,385 | A * | 8/2000 | Wakamatsu et al. | 270/58.12 |
| 6,241,234 | B1 * | 6/2001 | Saitoh et al. | 270/58.12 |
| 6,561,709 | B2 * | 5/2003 | McVeigh et al. | 400/625 |
| 6,832,066 | B2 | 12/2004 | Watanabe et al. | |
| 6,886,828 | B2 * | 5/2005 | Saito | 271/225 |
| 7,172,186 | B2 | 2/2007 | Saito et al. | |
| 7,210,681 | B2 | 5/2007 | Asako | |
| 7,703,757 | B2 | 4/2010 | Watanabe et al. | |
| 7,941,063 | B2 | 5/2011 | Suzuki et al. | |
| 2006/0255524 | A1 * | 11/2006 | Isobe et al. | 270/58.08 |
| 2008/0202302 | A1 | 8/2008 | Hayashi et al. | |
| 2009/0134563 | A1 | 5/2009 | Watanabe et al. | |
| 2009/0206538 | A1 * | 8/2009 | Fujii et al. | 270/58.18 |
| 2011/0089623 | A1 * | 4/2011 | Kato et al. | 270/58.07 |
| 2012/0205854 | A1 * | 8/2012 | Dinnissen | 270/58.08 |

FOREIGN PATENT DOCUMENTS

| | | | |
|---|---|---|---|
| CN | 1498769 | A | 5/2004 |
| CN | 1572693 | A | 2/2005 |
| JP | 2002-012361 | A | 1/2002 |
| JP | 2002012361 | A * | 1/2002 |
| JP | 2003-238021 | | 8/2003 |
| JP | 2003-238021 | A | 8/2003 |

OTHER PUBLICATIONS

Notification of Reason for Refusal, dated Oct. 18, 2012, issued by the Japanese Patent Office, in Japanese Patent Application No. 2010-261074.

Office Action issued in Chinese Application No. 201110377190.5 dated Dec. 31, 2013.

* cited by examiner

*Primary Examiner* — Patrick Mackey

(74) *Attorney, Agent, or Firm* — Fitzpatrick, Cella, Harper & Scinto

(57) ABSTRACT

The present invention prevents a succeeding sheet from being caught in holes of preceding punched sheets.

5 Claims, 9 Drawing Sheets

DEVICE FOR ALIGNING PUNCHED SHEETS

BACKGROUND OF THE INVENTION

1. Field of the Invention

The present invention relates to a sheet processing apparatus which loads and processes punched sheets provided with holes as well as to an image forming apparatus equipped with the sheet processing apparatus.

2. Description of the Related Art

Conventionally, image forming apparatus, such as copiers, printers, facsimile machines and multi-functional peripherals, which form images on sheets are sometimes equipped with a sheet processing apparatus adapted to load the sheets one after another onto a processing tray once after an image is formed on the sheets by an image forming unit, and width-adjust the sheets on the processing tray, and then discharge the sheets (Japanese Patent Application Laid-Open No. 2003-238021).

The conventional sheet processing apparatus are designed to load a succeeding sheet on preceding punched sheets already loaded on the processing tray even when width-adjusting punched sheets in which filing holes are formed near a lateral edge along a sheet conveying direction.

However, when discharged onto the preceding punched sheets, the succeeding sheet is loaded on top of the preceding punched sheets, with the leading edge of the succeeding sheet sliding over the preceding punched sheets. Consequently, the leading edge of the succeeding sheet could get caught in holes of one or more of the preceding punched sheets, thereby pushing the preceding punched sheet(s) out of the processing tray.

In particular, if the leading edge of the succeeding sheet is curled toward the punched sheets or if hole edges are burred as a result of punching, the leading edge of the succeeding sheet is liable to get caught in holes of the punched sheets. Also, a leading edge corner of the succeeding sheet can at times get bent when caught in holes of the punched sheets.

Thus, it is difficult for the conventional sheet processing apparatus to apply a width adjustment to punched sheets before discharging the punched sheets.

SUMMARY OF THE INVENTION

It is a feature of the present invention to provide a sheet processing apparatus which prevents a succeeding sheet from being caught in holes of preceding punched sheets and thereby allows easy width adjustment of punched sheets as well as to provide an image forming apparatus equipped with the sheet processing apparatus.

A sheet processing apparatus according to the present invention includes: a sheet discharge member adapted to discharge sheets; a sheet-carrying unit adapted to carry the sheets discharged by the sheet discharge member; moving members adapted to move the sheets carried by the sheet-carrying unit, in a width direction intersecting a sheet conveying direction; and a control unit adapted to control movement of the moving members in the width direction, wherein based on information that the sheets are punched sheets in which holes are formed near a lateral edge along the sheet conveying direction, each time a punched sheet is loaded on the sheet-carrying unit, the control unit moves the moving members in the width direction by a distance larger than width of a holed area in a lateral edge portion of the punched sheet, and thereby moves the punched sheet in the width direction.

An image forming apparatus according to the present invention includes: an image forming unit adapted to form an image on sheets; and the sheet processing apparatus described above.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

A sheet processing apparatus according to an embodiment of the present invention and an image forming apparatus equipped with the sheet processing apparatus will be described below with reference to the drawings.

In the present embodiment, a width of a sheet refers to the length of the sheet in a direction intersecting a sheet conveying direction. Numerical values cited in the present embodiment are reference values and are not intended to limit the present invention.

Figure 1:
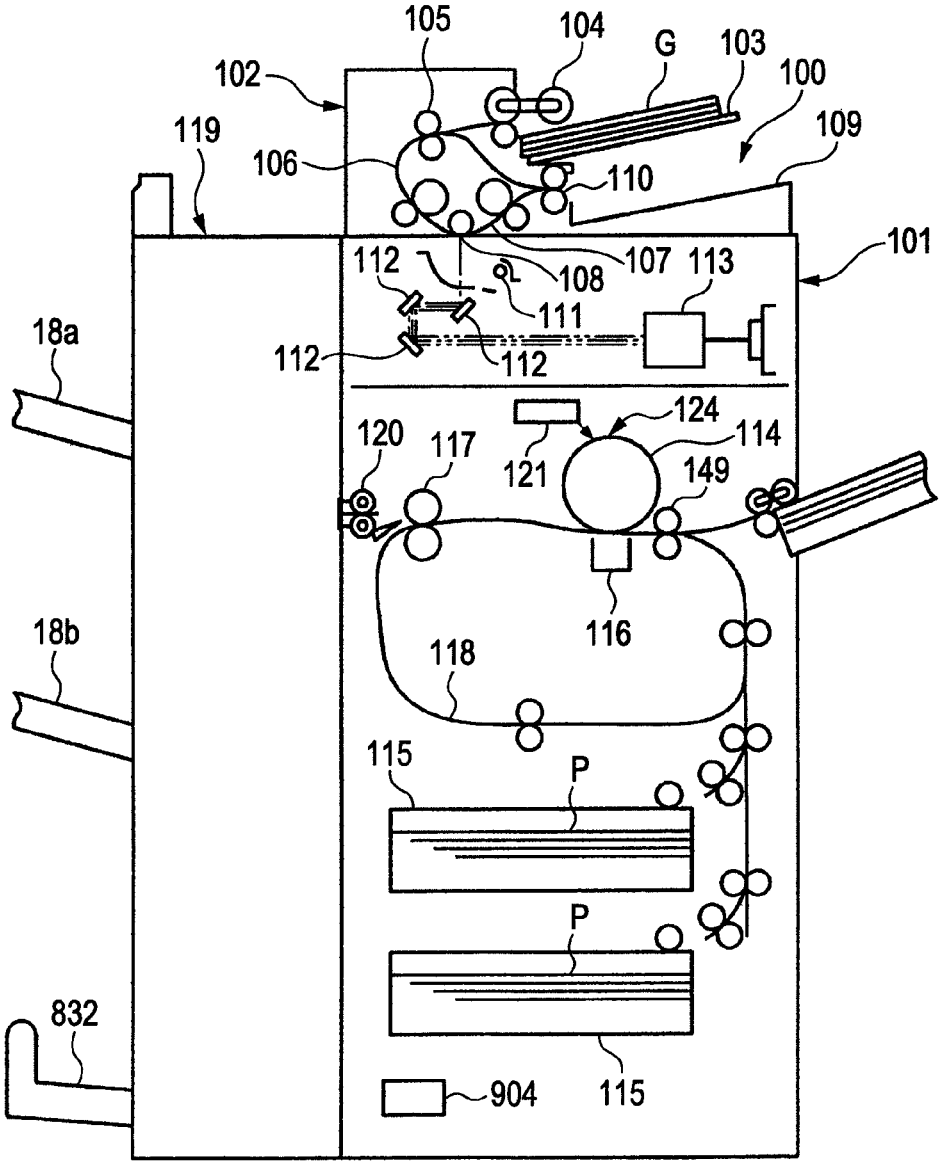
FIG. 1 is a sectional view of an image forming apparatus according to an embodiment of the present invention along a sheet conveying direction, where the image forming apparatus is equipped with a finisher which is a sheet processing apparatus according to the embodiment of the present invention.

FIG. 1 is a sectional view of an image forming apparatus according to an embodiment of the present invention along a sheet conveying direction, where the image forming apparatus is equipped with a sheet processing apparatus according to the embodiment of the present invention.

An electrophotographic copier 100 serving as an image forming apparatus includes an apparatus body 101 and a finisher 119 serving as a sheet processing apparatus. A document feeder 102 is installed on top of the apparatus body 101.

An original G placed on a document mounting unit 103 of the document feeder 102 by a user is separated into sheets one after another by a feeding unit 104 and conveyed to a registration roller pair 105. Then, the original G is stopped once, formed into a loop to correct any skew, and thereby straightened out by the registration roller pair 105. After being corrected and straightened, the original G passes through an introduction path 106 and a read position 108, at which images are read out of the original G. After passing through the read position 108, the original G is discharged to an output tray 109 through an output path 107.

In the case where images are formed on both sides of the original G, to read the images from both sides, first the image on one side is read when the original G passes the read position 108 as described above. Then, after passing through the output path 107, the original G is conveyed in the reverse direction by a reversal roller pair 110, turned over, and sent again to the registration roller pair 105. Then, in a manner similar to when the image is read from the first side, the original G has any skew corrected by the registration roller pair 105, passes through the introduction path 106, and goes to the read position 108, at which an image is read from the second side. Finally, the original G is discharged to the output tray 109 through the output path 107.

When passing through the read position 108, the original is illuminated with light from an illumination system 111. Light reflected off the original is led by a mirror 112 to an optical device 113 (CCD or other device), thereby converted into image data, and further converted into laser light by a laser scanner 121. The laser scanner 121 emits a laser beam to a photosensitive drum 114 charged in advance. Consequently, a latent image is formed around the photosensitive drum 114. The latent image is developed by a toner developer 122 and thereby visualized into a toner image.

The photosensitive drum 114, toner developer 122 and the like make up an image forming unit 124.

Along with the toner image forming operation, a sheet P of paper, plastic film or the like carried by a cassette 115 is sent out of the cassette 115, has any skew corrected by a registration roller pair 123, and thereby becomes straight. Subsequently, the sheet P is positioned accurately in relation to the toner image on the photosensitive drum 114 by the registration roller pair 123 and fed into space between the photosensitive drum 114 and a transfer device 116. Then, the toner image on the photosensitive drum 114 is transferred onto the sheet P by the transfer device 116. The transferred toner image is fixed to the sheet P by pressing and heating while the sheet P passes through the fixing device 117.

In the case where toner images are formed on both sides of the sheet, the sheet with a toner image formed on one side is guided along a duplex path 118 provided on a downstream side of the fixing device 117 and is sent into the space between the photosensitive drum 114 and transfer device 116 again, and then a toner image is transferred to the reverse side. Then, the toner image on the reverse side is fixed by the fixing device 117 and the sheet is discharged to the finisher 119.

In the above description, the original can be read if placed on top of the apparatus body 101 and illuminated with light from the illumination system 111, and thus the document feeder 102 is not absolutely necessary.

Figure 2:
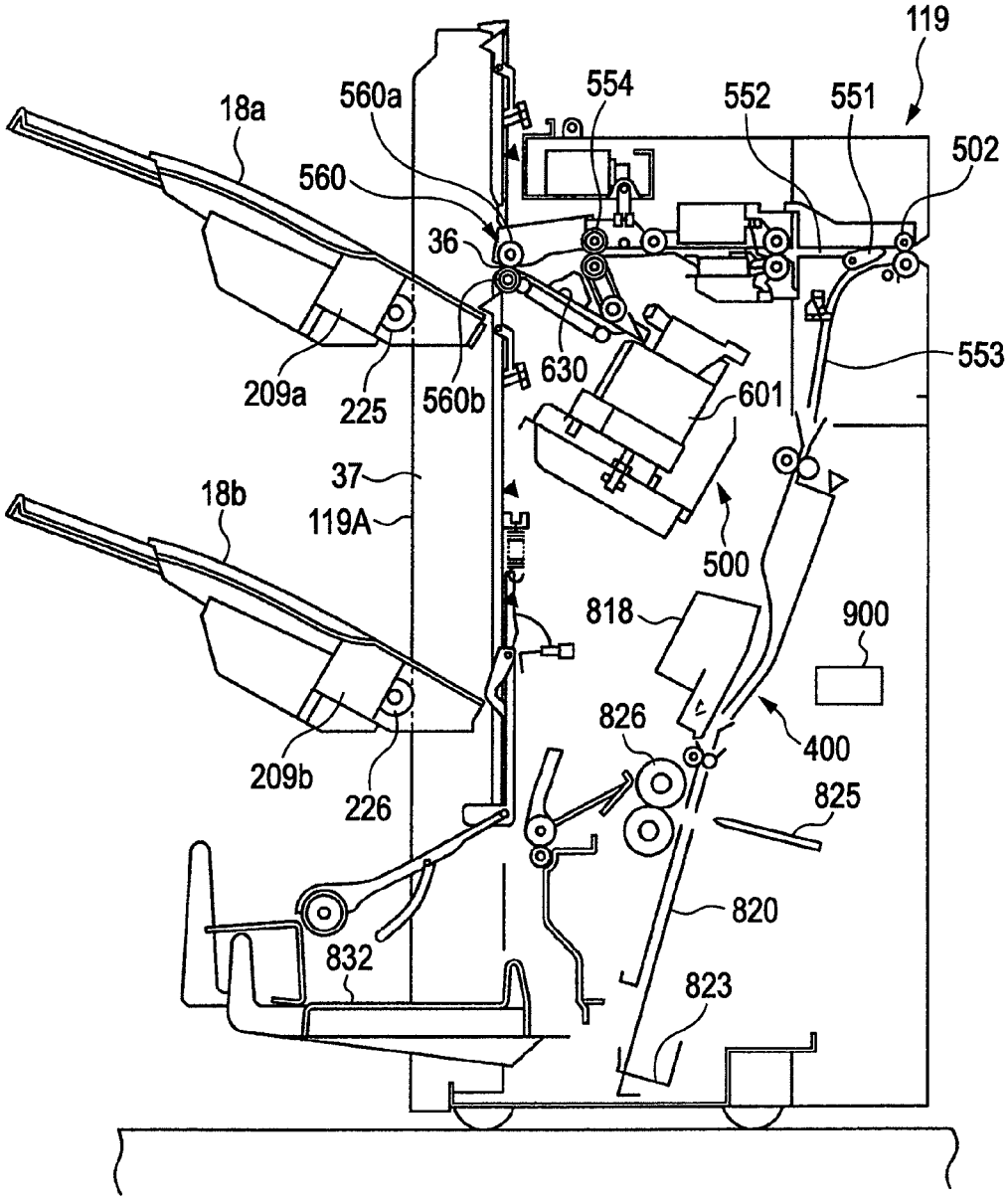
FIG. 2 is a sectional view of the finisher in FIG. 1 along the sheet conveying direction.
Figure 3:
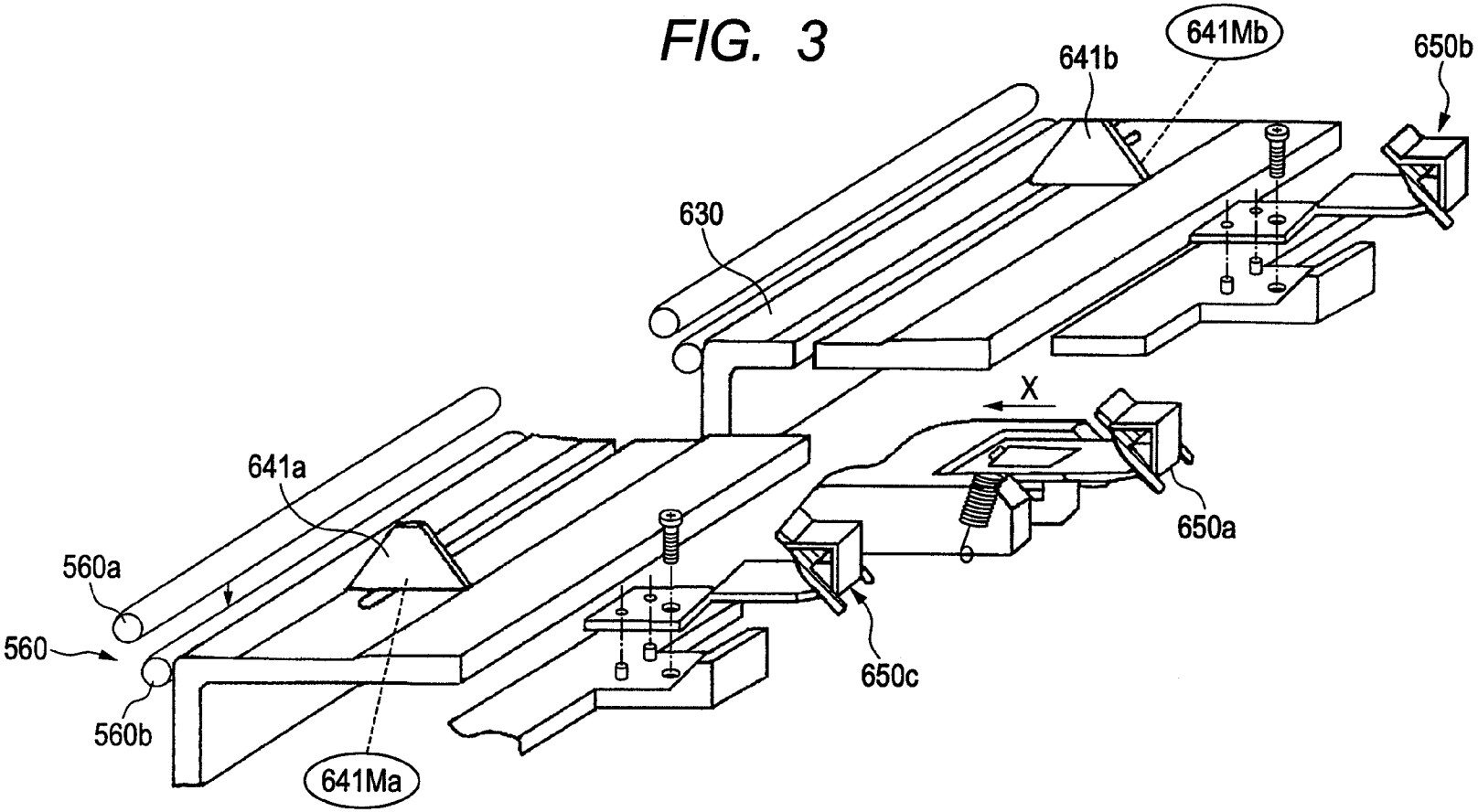
FIG. 3 is an exploded perspective view of a processing tray of the finisher in FIG. 1.

FIG. 2 is a sectional view of the finisher along the sheet conveying direction, where the finisher serves as a sheet post-processing apparatus according to the embodiment of the present invention. FIG. 3 is an exploded perspective view of a processing tray.

The finisher 119 is designed to be able to perform at least one type of sheet processing which includes a sorting process, non-sorting process, stapling process and binding process, where the sorting process involves taking in sheets one after another when the sheets are discharged from the apparatus body 101 and bundling the sheets after adjustment while the stapling process involves stapling each bundle of sheets using a stapler. For that, the finisher 119 is equipped with a folder 400 and processor 500.

The processor 500 is provided with an entrance roller pair 502 adapted to lead the sheet conveyed from the apparatus body 101, into the processor 500. A guide member 551 is provided downstream of the entrance roller pair 502 to lead the sheet to a sort path 552 in sorting mode or non-sorting mode and lead the sheet to a binding path 553 in binding mode.

The sheet led by the guide member 551 to the sort path 552 is discharged onto a processing tray (intermediate tray) 630 by an intermediate roller pair 554. In so doing, the sheet is conveyed downstream once as a paper discharge/convey roller pair 560 rotates in normal direction by a predetermined amount. Then, the sheet is conveyed upstream by rotation in reverse direction, and the rear end of the sheet is adjusted by abutting against rear end stoppers 650*b* and 650*c* (FIG. 3). When the sheet is loaded onto the processing tray 630, an upper roller 560*a* of the paper discharge/convey roller pair 560 (FIG. 3) goes up and thereby separates from a lower roller 560*b* and receives the sheet between itself and the lower roller 560*b*. Subsequently, the upper roller 560*a* moves down, pinches the sheet between itself and the lower roller 560*b*, and rotates in normal direction and then in reverse direction. The upper roller 560*a* performs this operation each time a sheet is discharged onto the processing tray 630.

The sheet has its width adjusted by width adjustment plates 641*a* and 641*b* (FIG. 3). A near-side width adjustment plate 641*a* is designed to move in a sheet width direction by rotation of a near-side adjustment motor 641Ma via a rotational force transmission mechanism (not shown). Also, an inner-side width adjustment plate 641*b* is designed to move in the sheet width direction by rotation of an inner-side adjustment motor 641Mb via a rotational force transmission mechanism (not shown). Sheet width adjustment by means of the width adjustment plates 641*a* and 641*b* will be described later.

The sheets loaded in a bundle on the processing tray are stapled by a stapler 601 as required and discharged onto a stacking tray (18*a* or 18*b*) through rotation of the paper discharge/convey roller pair 560 and movement of a rear end stopper 650*a* (FIG. 3) in the direction of arrow X.

The folder 400 is designed to perform a binding process and equipped with two staplers 818 arranged in a sheet width direction, a folding roller pair 826 adapted to fold a bundle of sheets, and a knock-out plate 825.

The sheets guided to the binding path 553 by the guide member 551 are stored in a storage guide 820, and then received and loaded by a positioning member 823 which has an ascendable/descendable tip (lower end). The sheets are loaded one after another onto the positioning member 823, forming a bundle. The bundled sheets are saddle-stapled by two staplers 818 (which overlap and appear as one in FIG. 2).

Subsequently, the positioning member 823 moves down to a position where a stapled portion of the bundle of sheets faces a tip of the knock-out plate 825. Then, the knock-out plate 825 pokes the stapled portion of the bundle of sheets stored in the storage guide 820, and thereby pushes the stapled portion into a nip in the folding roller pair 826. The folding roller pair 826 rotates and folds the bundle of sheets while conveying the bundle of sheets and discharges the bundle of sheets onto a saddle output tray 832. This finishes the binding process.

An upper stacking tray 18*a* and lower stacking tray 18*b* (FIG. 2) are designed to move up and down along a finisher body 119A by means of an upper tray motor 209*a* and lower tray motor 209*b*. The upper tray motor 209*a* and lower tray motor 209*b* rotate a pinion gear 225 and move the upper stacking tray 18*a* and lower stacking tray 18*b* up and down via a rack (not shown) formed in part of a strut 37 and meshed with the pinion gear 225. The upper stacking tray 18*a* and lower stacking tray 18*b* are designed to move down with increases in the number of loaded sheets to prevent the loaded sheets from blocking a discharge unit 36 through which the sheets are discharged.

Figure 4:
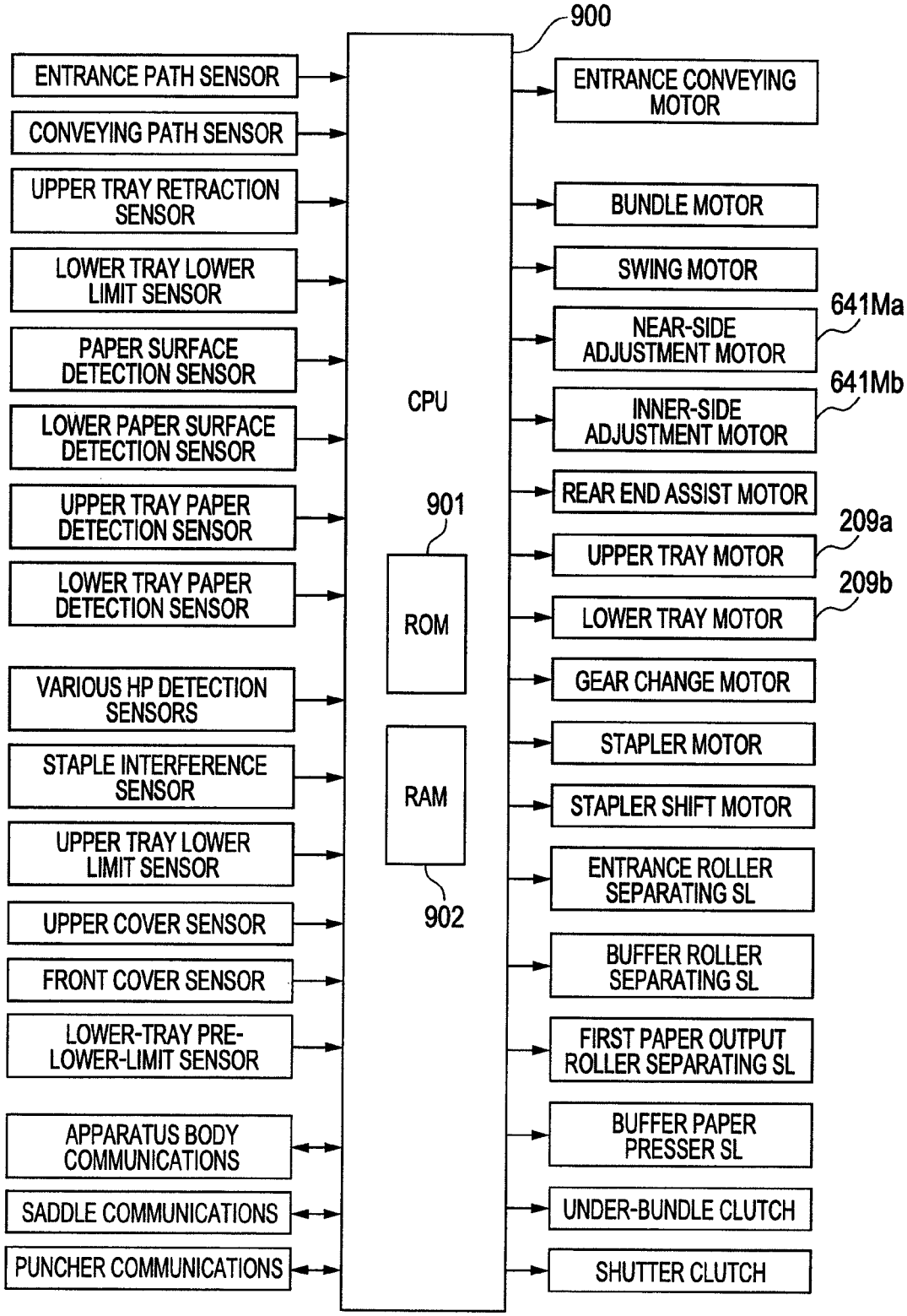
FIG. 4 is a control block diagram of the finisher in FIG. 1.

FIG. 4 is a control block diagram of the finisher 119.

A CPU 900 is designed to control a motor, solenoid, clutch and the like in the finisher 119 based on data stored in a ROM 901 and information temporarily stored in a RAM 902. In this case, the CPU 900 is designed to control the finisher 119 by exchanging information with a CPU 904 provided in the apparatus body 101 of the image forming apparatus and adapted to control the apparatus body 101. Incidentally, one of the CPU 900 and CPU 904 may be incorporated in the other.

Sensors adapted to input signals in the CPU 900 include an entrance path sensor, conveying path sensor, upper tray retraction sensor, lower tray lower limit sensor, paper surface detection sensor, lower paper surface detection sensor, upper tray paper detection sensor and lower tray paper detection sensor. Furthermore, there are various HP (home position) detection sensors, a staple interference sensor, an upper tray lower limit sensor, an upper cover sensor, a front cover sensor, a lower-tray pre-lower-limit sensor and so on.

The drive units controlled by the CPU 900 include an entrance conveying motor, a bundle motor, a swing motor, the near-side adjustment motor 641Ma, the inner-side adjustment motor 641Mb, a rear end assist motor, the upper tray motor 209*a*, the lower tray motor 209*b* and a gear change motor. Furthermore, there are a stapler motor, stapler shift motor, entrance roller separating SL (solenoid), buffer roller separating SL, first paper output roller separating SL, buffer paper presser SL, under-bundle clutch, shutter clutch and so on.

Figure 5:
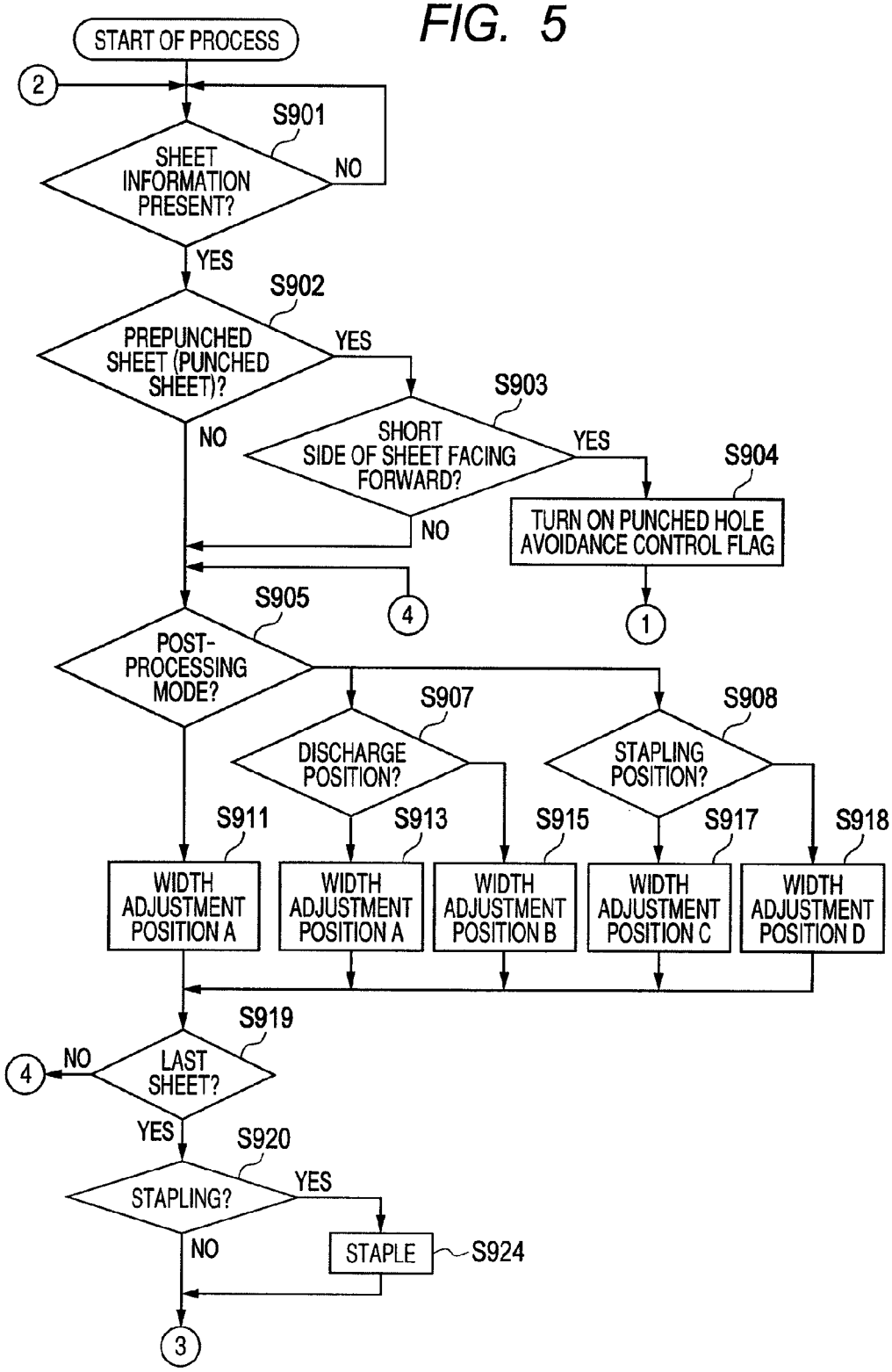
FIG. 5 is a flowchart for illustrating a sheet width adjustment operation of the finisher in FIG. 1.
Figure 6:
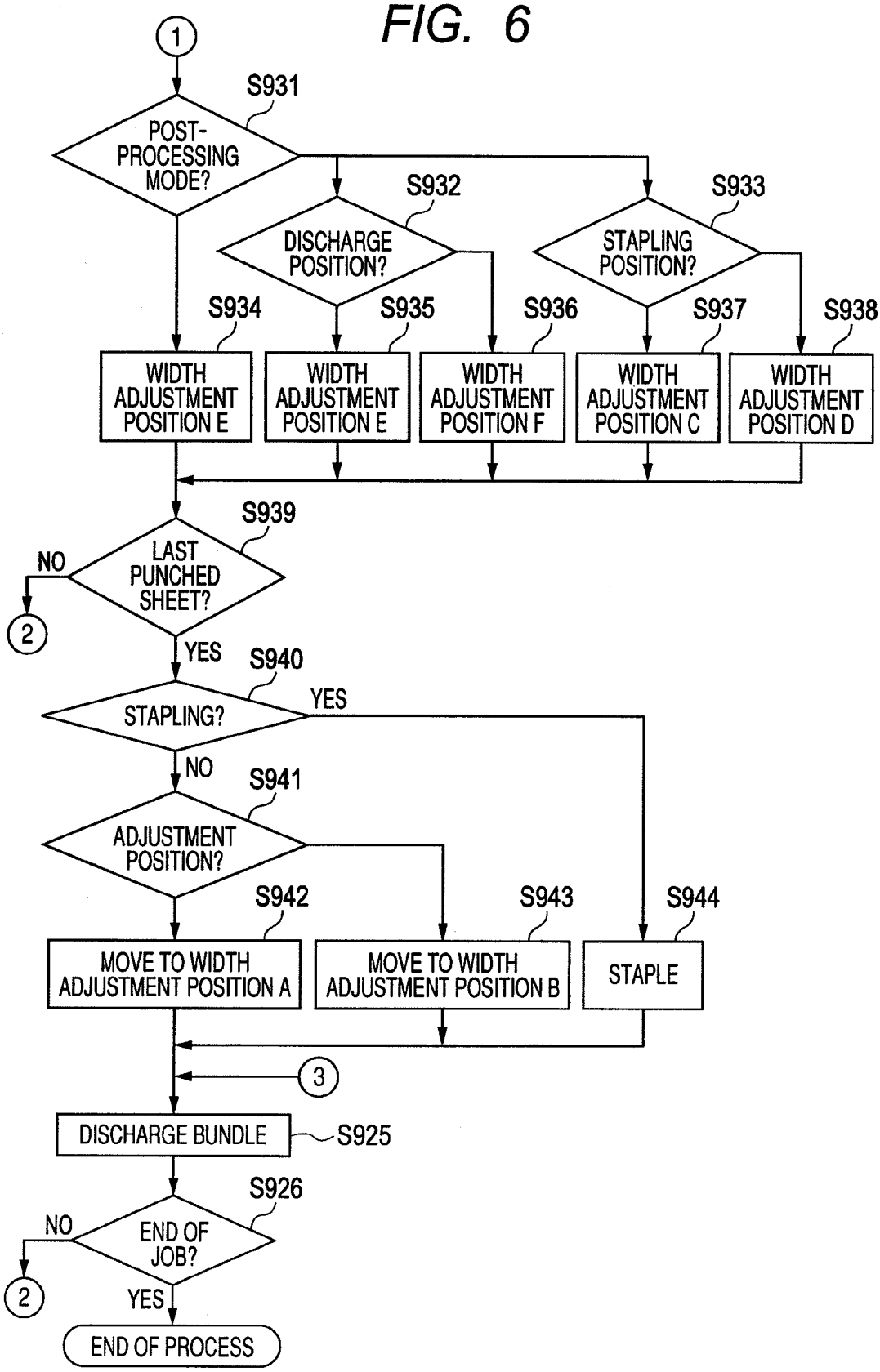
FIG. 6 is a flowchart for illustrating the sheet width adjustment operation of the finisher, continued from FIG. 5.

FIGS. 5 and 6 are a flowchart for illustrating a sheet width adjustment operation of the finisher 119. Operating procedures according to the flowchart shown in FIGS. 5 and 6 are stored in the ROM 901 and the CPU 900 is designed to control the finisher 119 according to the operating procedures stored in the ROM 901. FIGS. 7 to 11 are diagrams for illustrating the sheet width adjustment operation of the finisher 119.

Operation of a non-sorting process for unpunched sheets will be described.

The CPU 900 waits for sheet information about post-processing mode of the finisher 119 from the apparatus body 101 (S901). A sheet is led to the sort path 552 by the guide member 551 (FIG. 2) and discharged onto the processing tray 630 by the intermediate roller pair 554 serving as a sheet discharge member. In so doing, as the paper discharge/convey roller pair 560 rotates in normal direction, the sheet is conveyed on the processing tray 630 by a predetermined distance downstream by passing through a position indicated by symbol M in FIG. 7.

Then, the sheet is conveyed upstream by rotation of the paper discharge/convey roller pair 560 in reverse direction, and stops at a position indicated by symbol A (FIG. 7) for rear end adjustment as the rear end of the sheet abuts against the rear end stoppers 650*b* and 650*c* (FIG. 3). The position indicated by symbol A is where the sheet conveyed along the sort path 552 with the centers of the sheet and path in the width direction aligned with each other is loaded onto the processing tray 630 with its center aligned with the width-direction center CL of the processing tray 630. In other words, the position indicated by symbol A is where the sheet conveyed with its center aligned with the center of the path in the width direction undergoes rear end adjustment without being width-adjusted by the near-side width adjustment plate 641*a* and inner-side width adjustment plate 641*b*.

Upon receiving sheet information (YES in S901) indicating a non-prepunched sheet (non-punched sheet) (NO in S902) and non-sorting mode (S905 and S911), the CPU 900 controls the near-side adjustment motor 641Ma (FIG. 3) and inner-side adjustment motor 641Mb. The pair of the near-side width adjustment plate 641*a* and inner-side width adjustment plate 641*b* serving as moving members approach each other from a waiting position indicated by a solid line in FIG. 7, width-adjust the sheet to a width adjustment position indicated by A in FIG. 7, and then leave the adjustment position A to receive a next sheet.

After width-adjusting a predetermined number of conveyed sheets to the width adjustment position A and confirming that the last sheet has been width-adjusted (YES in S919), the CPU 900 checks whether or not a stapling process is to be performed (S920). The sheets may be width-adjusted either one by one each time a sheet is loaded onto the processing tray 630 or all at once when the last sheet is loaded. As the sheet information received in S901 does not indicate a stapling process (NO in S920), the CPU 900 controls the rotation of the paper discharge/convey roller pair 560 (FIG. 3) and movement of the rear end stopper 650*a* in the direction of arrow X. As a result, the bundle of sheets width-adjusted to the width adjustment position A is discharged onto one of the upper stacking tray 18*a* and lower stacking tray 18*b* (S925).

The CPU 900 repeats the non-sorting process of unpunched sheets until the end of the job and finishes control when the job ends (YES in S926).

Operation of a sorting process for unpunched sheets will be described.

Figure 7:
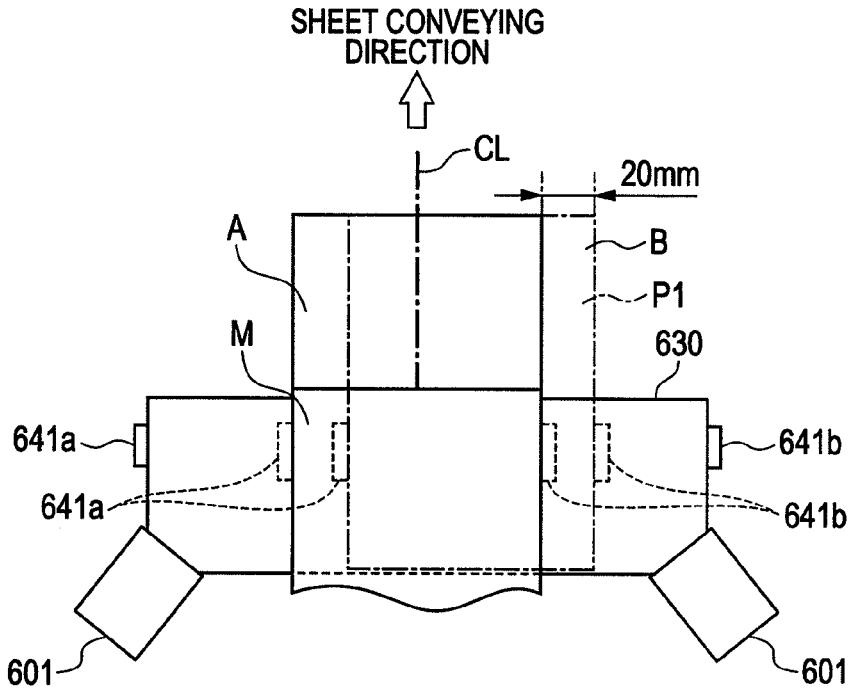
FIG. 7 is a diagram for illustrating an operation of the finisher when an unpunched sheet is led to a width adjustment position A as a result of a non-sorting process or led to the width adjustment position A or a width adjustment position B as a result of a sorting process.

As with the non-sorting process of unpunched sheets, the CPU 900 adjusts the rear end of the sheet loaded on the processing tray 630 to the position indicated by symbol A in FIG. 7.

Upon receiving sheet information (YES in S901) indicating a non-prepunched sheet (NO in S902), sorting mode (S905 and S907), and near-side adjustment (S913), the CPU 900 width-adjusts the sheet to the width adjustment position A. The reason why the width adjustment position A is referred to as near-side adjustment position is that the width adjustment position A is located on a nearer side than is a width adjustment position B described later.

As with the non-sorting process of unpunched sheets, by operating the near-side width adjustment plate 641*a* and inner-side width adjustment plate 641*b*, the CPU 900 width-adjusts each sheet loaded on the processing tray 630 to the width adjustment position A until the last sheet is width-adjusted. When the last sheet is width-adjusted (YES in S919), the CPU 900 discharges the bundle of sheets stacked at the width adjustment position A onto one of the upper stacking tray 18*a* and lower stacking tray 18*b* (S925) without stapling the bundle (NO in S920).

However, since a sorting process of the sheets is specified, the process of width-adjusting the sheets to the width adjustment position B (S915, FIG. 7) remains to be performed (NO in S926). Thus, after going through S901, S902, S905 and S907, the CPU 900 width-adjusts the sheets to the width adjustment position B (shown in FIG. 7) in S915.

In this case, each time a sheet is loaded on a region indicated by symbol A on the processing tray 630, the CPU 900 reciprocates the near-side width adjustment plate 641*a* between the width adjustment position A and the width adjustment position B moved 20 mm toward the width-direction center CL of the processing tray 630 from the width adjustment position A. Consequently, the inner-side width adjustment plate 641*b* is reciprocated between the width adjustment position B and a position away from the width adjustment position B. This allows the near-side width adjustment plate 641*a* and inner-side width adjustment plate 641*b* to width-adjust the sheet by sandwiching the sheet at the width adjustment position B.

The CPU 900 width-adjusts all the sheets to the width adjustment position B (YES in S919), and finishes the sorting process when the result of decision in S920 is NO and the result of decision in S926 after S925 is YES.

Consequently, on a stacking tray (18*a* or 18*b*), the bundle of sheets width-adjusted at the width adjustment position A and the bundle of sheets width-adjusted to the width adjustment position B are offset-loaded, being offset 20 mm from each other in the width direction.

Operation of a stapling process for unpunched sheets will be described.

As with the non-sorting process of unpunched sheets, the CPU 900 adjusts the rear end of the sheet loaded on the processing tray 630, to the position indicated by symbol A.

Figure 8:
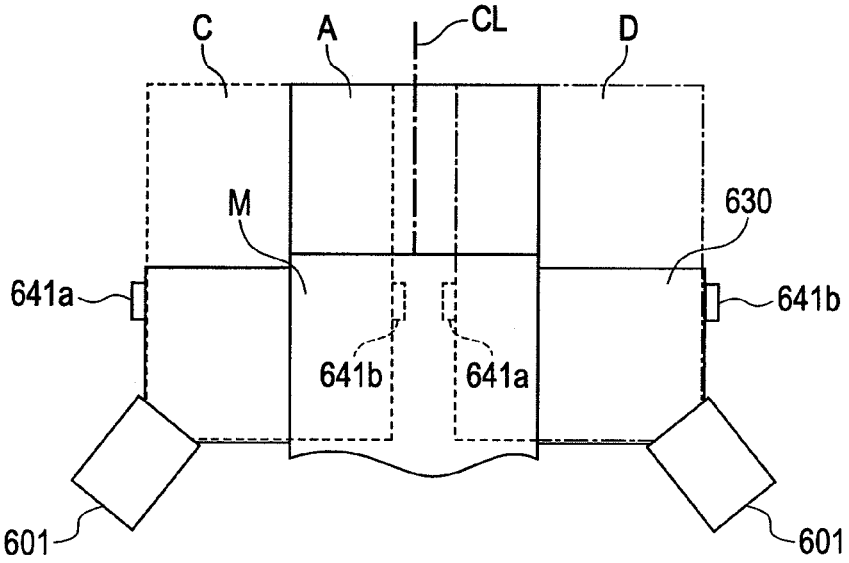
FIG. 8 is a diagram for illustrating an operation of the finisher when unpunched sheets are stapled.
Figure 9:
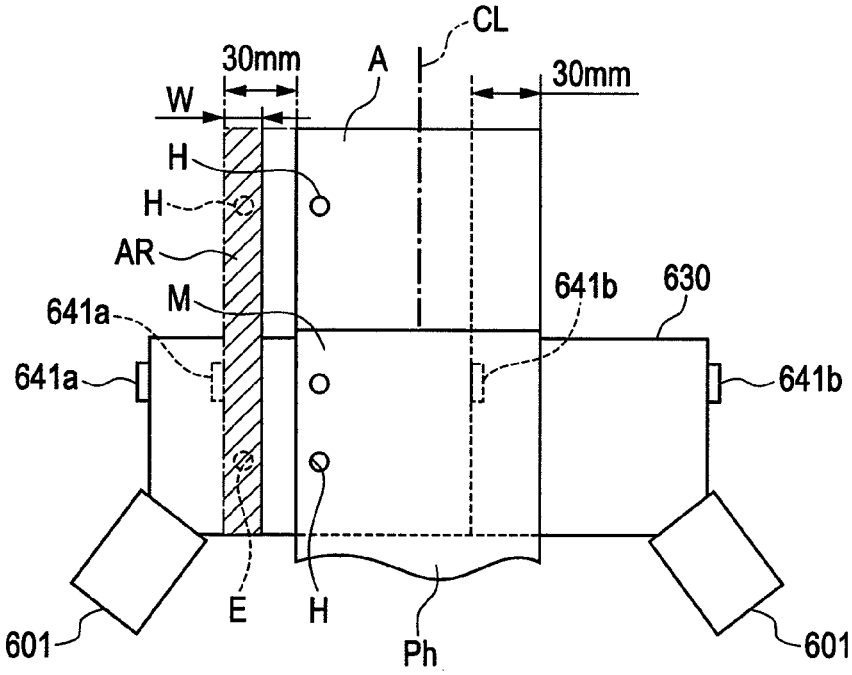
FIG. 9 is a diagram for illustrating an operation of the finisher when a punched sheet is led to a width adjustment position E as a result of a non-sorting process or sorting process.
Figure 10:
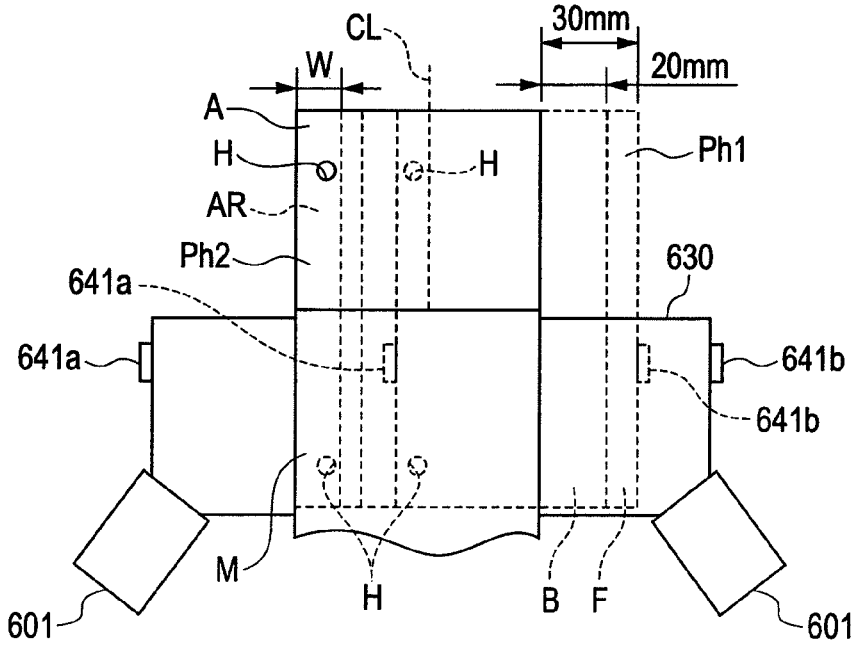
FIG. 10 is a diagram for illustrating an operation of the finisher when a punched sheet is led to a width adjustment position F as a result of a sorting process.

Upon receiving sheet information (YES in S901) indicating a non-prepunched sheet (NO in S902), stapling mode (S905 and S908), and near-side stapling at a width adjustment position C in FIG. 8 (S917), the CPU 900 controls the inner-side adjustment motor 641Mb.

In FIG. 8, the near-side width adjustment plate 641*a* and inner-side width adjustment plate 641*b* are waiting at positions indicated by solid lines. By passing through a position indicated by symbol M, the sheet is loaded at a position indicated by symbol A. Subsequently, with the near-side width adjustment plate 641*a* remaining stopped at the waiting position, the inner-side width adjustment plate 641*b* moves to a position indicated by a broken line by passing through the width-direction center CL of the processing tray and stops by pressing the sheet against the near-side width adjustment plate 641*a*.

The pair of the near-side width adjustment plate 641*a* and inner-side width adjustment plate 641*b* are designed to move selectively to one of opposite sides along the sheet width direction according to the width adjustment position under the control of the CPU 900.

Subsequently, the inner-side width adjustment plate 641*b* moves to a position away from the adjustment positions C and A to receive a next sheet. The CPU 900 repeats this control until the last sheet is width-adjusted to the width adjustment position C (YES in S919). Then, the CPU 900 moves the stapler 601 leftward in FIG. 8 and staples the upstream left corner of the bundle of sheets (S924 as a result of YES decision in S920). Then, the paper discharge/convey roller pair 560 (FIG. 3) and rear end stopper 650*a* discharge the stapled bundle of sheets onto one of the stacking trays 18*a* and 18*b* from the width adjustment position B. The CPU 900 repeats the above control until the end of the job (YES in S926).

In the case of inner-side stapling at a width adjustment position D in FIG. 8 (S918) or two-point stapling at the rear end, the CPU 900 controls the near-side adjustment motor 641Ma in S908. In FIG. 8, the near-side width adjustment plate 641*a* and inner-side width adjustment plate 641*b* are waiting at positions indicated by solid lines. By passing through the position indicated by symbol M, the sheet undergoes rear end adjustment at a position indicated by symbol A. Subsequently, with the inner-side width adjustment plate 641*b* remaining stopped at the waiting position, the near-side width adjustment plate 641*a* moves to a position indicated by a broken line by passing through the width-direction center CL of the processing tray and stops by pressing the sheet against the inner-side width adjustment plate 641*b*. Subsequently, the near-side width adjustment plate 641*a* moves to a position away from the width adjustment positions D and A to receive a next sheet. The CPU 900 repeats this control until the last sheet (S919) is width-adjusted to the width adjustment position D. Then, the CPU 900 moves the stapler 601 rightward in FIG. 8 and staples a corner of the bundle of sheets (S924 as a result of YES decision in S920). Alternatively, the CPU 900 staples the rear end of the bundle of sheets at two points. Then, the paper discharge/convey roller pair 560 (FIG. 3) and rear end stopper 650*a* discharge the stapled bundle of sheets onto one of the stacking trays 18*a* and 18*b* from the width adjustment position D.

Operation of a non-sorting process for punched sheets provided with holes will be described.

It is assumed that punched sheets are sheets which have been punched by a punching apparatus (not shown) in the apparatus body 101 of the image forming apparatus or in the finisher 119.

When a punched sheet Ph provided with holes is brought in with a short side facing forward in Steps S901, S902 and S903, the CPU 900 turns on a punched hole avoidance control flag of the CPU 900 (S904). Since the sheet information indicates a non-sorting process in S931, after passing through the position indicated by symbol M in FIG. 9, the CPU 900 adjusts the rear end of the punched sheet at a position indicated by symbol A and width-adjusts the punched sheet to a width adjustment position E (S934). That is, by controlling the near-side adjustment motor 641Ma (FIG. 3), the CPU 900 moves the near-side width adjustment plate 641*a* from the waiting position indicated by a solid line to an adjustment position indicated by a broken line. Also, by controlling the inner-side adjustment motor 641Mb (FIG. 3), the CPU 900 moves the inner-side width adjustment plate 641*b* from the waiting position indicated by a solid line to a width adjustment position indicated by a broken line. Consequently, the punched sheet is width-adjusted to the width adjustment position E located 30 mm to the left of the width adjustment position A.

The width adjustment position E is designed such that when the succeeding punched sheet is discharged at positions M and A, the succeeding punched sheet will not overlap holes H in the punched sheets loaded earlier on the processing tray 630 serving as a sheet-carrying unit.

In this way, based on information that the sheets are punched sheets Ph in which holes are formed near a lateral edge along the sheet conveying direction, the CPU 900 serving as a control unit controls operations of the near-side width adjustment plate 641*a* and inner-side width adjustment plate 641*b* serving as moving members. Each time a punched sheet is loaded on the processing tray 630 serving as a sheet-carrying unit, the CPU 900 moves the inner-side width adjustment plate 641*b* in the width direction from the adjustment position A by a distance larger than width W of a holed area in a lateral edge portion of the punched sheet, and thereby moves the punched sheet in the width direction. This control is repeated until the last punched sheet is processed (YES in S939). As a result, the finisher 119 can prevent a leading edge corner (downstream left corner in FIG. 9) of the succeeding punched sheet discharged onto the processing tray 630 from being trapped in holes H of the punched sheets loaded earlier on the processing tray 630. The width W of a holed area is the width W of the area AR (hatched area in FIG. 9) containing the holes H from the lateral edge of the sheet along the sheet conveying direction.

When the last punched sheet is processed (YES in S939), the CPU 900 determines the current width adjustment position. Since the current width adjustment position in Step S934 is E, the CPU 900 moves the near-side width adjustment plate 641*a* and inner-side width adjustment plate 641*b* 30 mm to the right in FIG. 9, and thereby moves the bundle of sheets in the width direction to the width adjustment position A (S942). As a result, the bundle of sheets coincides in the width-direction center with the processing tray 630.

After moving the bundle of sheets to the width adjustment position A, the CPU 900 discharges the bundle of sheets to a stacking tray (18*a* or 18*b*). The CPU 900 repeats the above control until the end of the job (YES in S926).

Operation of a sorting process for punched sheets provided with holes will be described.

When a punched sheet Ph provided with holes is brought in with a short side facing forward in Steps S901, S902 and S903, the CPU 900 turns on a punched hole avoidance control flag of the CPU 900 (S904). Since the sheet information indicates a sorting process and near-side adjustment (S931, S932 and S935), after passing through the position indicated by symbol M in FIG. 9, the CPU 900 adjusts the rear end of the punched sheet at a position indicated by symbol A and width-adjusts the punched sheet to a width adjustment position E. That is, as in the case of Step S934, by controlling the near-side adjustment motor 641Ma (FIG. 3) and inner-side adjustment motor 641Mb, the CPU 900 moves the near-side width adjustment plate 641*a* (FIG. 3) and inner-side width adjustment plate 641*b* from the waiting positions indicated by solid lines to the adjustment positions indicated by a broken lines. Consequently, the punched sheet is width-adjusted to the width adjustment position E located 30 mm to the left of the width adjustment position A.

The width adjustment position E is designed such that when the succeeding punched sheet is discharged at positions M and A, the succeeding punched sheet will not overlap the holes in the punched sheets loaded earlier on the processing tray 630.

In this way, based on information about the punched sheets Ph, each time a punched sheet is loaded on the processing tray 630, the CPU 900 moves the inner-side width adjustment plate 641*b* in the width direction from the width adjustment position A by a distance larger than the width W of a holed area, and thereby moves the punched sheet Ph in the width direction. This control is repeated until the last punched sheet is processed (YES in S939). As a result, the finisher 119 can prevent a leading edge corner (downstream left corner in FIG. 9) of the succeeding punched sheet discharged onto the processing tray 630 from being trapped in holes H of the punched sheets loaded earlier on the processing tray 630.

When the last punched sheet is processed (YES in S939), the CPU 900 determines the current width adjustment position. Since the current width adjustment position in Step S935 is E, the CPU 900 moves the near-side width adjustment plate 641*a* and inner-side width adjustment plate 641*b* to the right in FIG. 9 by 30 mm, and thereby moves the bundle of sheets in the width direction to the width adjustment position A (S942).

In this way, the near-side width adjustment plate 641*a* is designed to be able to move the punched sheet so as to bring the width-direction center of the punched sheet into coincidence with the width-direction center CL of the processing tray corresponding to the center position in the width direction with respect to the sheet conveying direction.

After moving the bundle of sheets to the width adjustment position A, the CPU 900 discharges the bundle of sheets to a stacking tray (18*a* or 18*b*).

However, since a sorting process of the sheets is specified, the process of width-adjusting the sheets to a width adjustment position F (S936, FIG. 10) remains to be performed (NO in S939). Thus, the CPU 900 returns to S901, goes through S902 and the like, and then width-adjusts the sheets to the width adjustment position F (shown in FIG. 10) in S936. In this case, the CPU 900 causes the inner-side width adjustment plate 641*b* to wait at the position indicated by a broken line and located 30 mm to the right of the width adjustment position A and when a sheet is loaded onto the processing tray 630, the CPU 900 moves the near-side width adjustment plate 641*a* to the right of the width adjustment position A by 30 mm. Consequently, the sheet is width-adjusted to the width adjustment position F.

Incidentally, to width-adjust sheets to the width adjustment position F, the near-side width adjustment plate 641*a* may be reciprocated between the width adjustment position A and width adjustment position F while the inner-side width adjustment plate 641*b* is left to wait at a position 30 mm or more away from the width adjustment position A.

The width adjustment position F is designed such that when a succeeding punched sheet Ph2 is discharged at positions M and A, a leading edge corner (downstream left corner in FIG. 10) of the succeeding punched sheet Ph2 will not overlap the holes in a punched sheet Ph1 loaded earlier on the processing tray 630.

In this way, based on information about the punched sheets Ph, each time a punched sheet is loaded on the processing tray 630, the CPU 900 moves the near-side width adjustment plate 641*a* in the width direction from the width adjustment position A by a distance larger than the width W of a holed area, and thereby moves the punched sheet Ph in the width direction. This control is repeated until the last punched sheet is processed (YES in S939). As a result, the finisher 119 can prevent a leading edge corner (downstream left corner in FIG. 9) of the succeeding punched sheet discharged onto the processing tray 630 from being trapped in holes H of the punched sheets loaded earlier on the processing tray 630.

The CPU 900 width-adjusts sheets to the width adjustment position F until the last punched sheet is processed (YES in S939).

When the last punched sheet is processed (YES in S939), the CPU 900 determines the current width adjustment position. Since the current width adjustment position in Step S936 is F, the CPU 900 moves the sheets to the width adjustment position B shown in FIG. 10 (S943). The width adjustment position B is located 20 mm to the right of the width adjustment position A. Thus, in order to move the bundle of sheets 10 mm to the left of the width adjustment position F, the CPU 900 moves the near-side width adjustment plate 641*a* and inner-side width adjustment plate 641*b* 10 mm to the left in FIG. 10, and thereby moves the bundle of sheets in the width direction to the width adjustment position B. Consequently, the width-direction center of the bundle of sheets is placed 10 mm to the right of the width-direction center CL of the processing tray 630.

After moving the bundle of sheets to the width adjustment position B, the CPU 900 discharges the bundle of sheets to a stacking tray (18*a* or 18*b*). The CPU 900 repeats the above control until the end of the job (YES in S926).

Consequently, the bundle of sheets width-adjusted to the width adjustment position A and the bundle of sheets width-adjusted to the width adjustment position B are loaded on the stacking tray, being offset from each other.

Incidentally, in the above description, the bundle of sheets width-adjusted to the width adjustment position E may be discharged after being moved to the width adjustment position B and the bundle of sheets width-adjusted to the width adjustment position F may be discharged after being moved to the width adjustment position A.

Operation of stapling the punched sheets provided with holes will be described.

When the results of decisions in S901, S902 and S903 are YES, after going through Steps S904, S931 and S933, the CPU 900 performs a near-side stapling process (S937). The near-side stapling process is performed at the width adjustment position C in FIG. 11. The width adjustment position C in FIG. 11 is the same as the width adjustment position C is FIG. 8.

Figure 11:
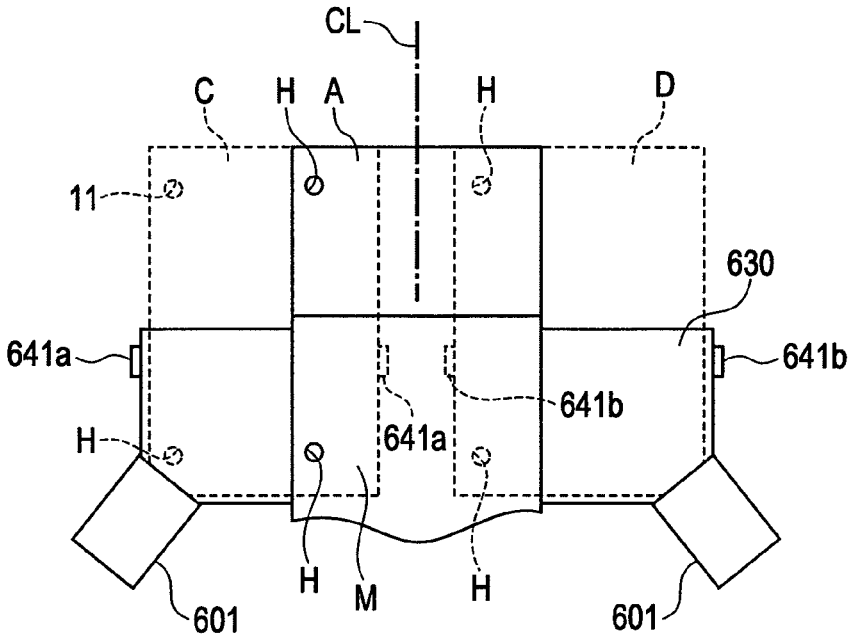
FIG. 11 is a diagram for illustrating an operation of the finisher when punched sheets are stapled at width adjustment positions C and D.

In FIG. 11, the near-side width adjustment plate 641*a* and inner-side width adjustment plate 641*b* are waiting at positions indicated by solid lines. The punched sheet is loaded at the position indicated by symbol A by passing through the position indicated by symbol M. Subsequently, with the near-side width adjustment plate 641*a* remaining stopped at the waiting position indicated by a solid line, the inner-side width adjustment plate 641*b* moves to a position indicated by a broken line by passing through the width-direction center CL of the processing tray and stops by pressing the punched sheet against the near-side width adjustment plate 641*a*. Subsequently, the inner-side width adjustment plate 641*b* waits at a position to the right of the adjustment position A to receive a next punched sheet. The CPU 900 repeats this control until the last sheet (S939) is width-adjusted to the width adjustment position C.

Again, since the succeeding sheet is discharged to the width adjustment position A after the previous punched sheets are moved to the width adjustment position C by being carried by the processing tray 630, a leading edge corner of the succeeding punched sheet does not get trapped in holes H of the previous punched sheets.

Then, the CPU 900 moves the stapler 601 leftward in FIG. 11 and staples the upstream left corner of the bundle of sheets (S944 as a result of YES decision in S940). Then, the paper discharge/convey roller pair 560 (FIG. 3) and rear end stopper 650*a* discharge the stapled bundle of sheets onto one of the stacking trays 18*a* and 18*b* from the width adjustment position B. The CPU 900 repeats the above control until the end of the job (YES in S926).

In the case of inner-side stapling or two-point stapling at the rear end at a width adjustment position D in FIG. 11 (S938), the CPU 900 controls the near-side adjustment motor 641Ma. In FIG. 11, the near-side width adjustment plate 641*a* and inner-side width adjustment plate 641*b* are waiting at positions indicated by solid lines. The sheet is loaded at the position indicated by symbol A by passing through the position indicated by symbol M. Subsequently, with the inner-side width adjustment plate 641*b* remaining stopped at the waiting position indicated by a solid line, the near-side width adjustment plate 641*a* moves to a position indicated by a broken line by passing through the width-direction center CL of the processing tray and stops by pressing the sheet against the inner-side width adjustment plate 641*b*. Subsequently, the near-side width adjustment plate 641*a* moves to a position to the left of the adjustment position A to receive a next sheet. The CPU 900 repeats this control until the last sheet (S939) is width-adjusted to the width adjustment position D. Then, the CPU 900 moves the stapler 601 rightward in FIG. 11 and staples the upstream right corner of the bundle of sheets (S944 as a result of YES decision in S940). Alternatively, the CPU 900 staples the rear end of the bundle of sheets at two points. Then, the paper discharge/convey roller pair 560 (FIG. 3) and rear end stopper 650*a* discharge the stapled bundle of sheets onto one of the stacking trays 18*a* and 18*b* from the width adjustment position D.

The bundle of sheets width-adjusted to the width adjustment position C is stapled at a corner on the side where holes are formed while the bundle of sheets width-adjusted to the width adjustment position D is stapled at a corner on the side where no hole is formed.

In the above description, if the result of decision in S903 is NO, it means that the punched sheet has been brought in with a long side facing forward. In this case, the holes of the punched sheet are arranged in a direction orthogonal to the conveying direction of the punched sheet because the holes are formed along a long side. Therefore, if the result of decision in S903 is NO, a leading edge corner of the succeeding punched sheet rarely gets trapped in holes H of the previous punched sheets, and thus the CPU 900 does not move the punched sheets loaded earlier on the processing tray in a direction orthogonal to the conveying direction.

Incidentally, although in the above description, holes are formed along a long side of the punched sheet, the present invention is also applicable even when the holes are formed along a short side. In that case, the punched sheet brought in with a long side facing forward is processed in S903.

Furthermore, the present invention is also applicable even when a hole is formed only at a corner of the sheet. Therefore, the present invention is not limited to punched sheets in which holes are formed along a long side.

Also, the present invention is applicable even when non-prepunched sheets and punched sheets are mixed together. In that case, even if a succeeding non-prepunched sheet is loaded onto a punched sheet, the succeeding non-prepunched sheet can be prevented from being trapped in a hole of the punched sheet.

Also, according to the present invention, a punching unit adapted to form holes along a long side may be placed upstream of the finisher and the sheet may be processed depending on whether or not the punching unit has formed holes.

With the finisher described above, if the sheets already loaded on the processing tray 630 are punched sheets, the holed area AR is moved in the sheet width direction to prevent a leading edge corner of the sheet loaded later from being trapped in holes of the punched sheets.

This prevents the succeeding sheet from pushing one or more of the preceding punched sheets out of the processing tray.

Also, when the succeeding sheet moves backward on the punched sheets and abuts against the rear end stoppers 650*b* and 650*c* to adjust the rear end of the succeeding sheet, a trailing edge corner of the succeeding sheet is kept from being trapped in holes of the punched sheets. This prevents rear end adjustment of the succeeding sheet from being disturbed.

Furthermore, the finisher can prevent the leading edge corners or trailing edge corners of the succeeding sheet from being caught in holes of the punched sheets and thereby prevent the leading edge corners or trailing edge corners from bending.

Also, the image forming apparatus equipped with the finisher reduces the possibility of forming an image twice on a single sheet and thereby improves the efficiency of image formation.

The sheet processing apparatus according to the present embodiment is designed such that each time a punched sheet is loaded on the sheet-carrying unit, the punched sheet is moved in the width direction to prevent a leading edge corner of the succeeding sheet discharged onto the sheet-carrying unit from being caught in holes of the punched sheets loaded earlier on the sheet-carrying unit. Consequently, the sheet processing apparatus according to the present invention can prevent the punched sheet discharged earlier from being dropped from the sheet-carrying unit by the succeeding sheet. Also, the sheet processing apparatus can prevent the corners of the succeeding sheet from being caught and bent by holes in the punched sheets.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-261074, filed Nov. 24, 2010, which is hereby incorporated by reference herein in its entirety.

What is claimed is:

1. A sheet processing apparatus comprising:

a sheet discharge member adapted to discharge a sheet;

a sheet-carrying unit adapted to carry the sheet discharged by the sheet discharge member;

a moving member adapted to move the sheet discharged to the sheet-carrying unit in a first direction intersecting a sheet discharging direction and in a second direction opposite to the first direction; and a control unit adapted to control movement of the moving member, wherein based on information that the sheet is a punched sheet in which a hole is formed, the control unit moves the moving member to move a sheet discharged by the sheet discharge member in the first direction before a succeeding sheet is discharged to the sheet-carrying unit by the sheet discharge member, and the control unit moves the moving member to move the sheet to a predetermined position by moving the sheet in the second direction after the succeeding sheet is discharged to the sheet-carrying unit by the sheet discharge member.

2. The sheet processing apparatus according to claim 1, wherein a distance by which the control unit moves the moving member in the first direction to move a punched sheet is a distance provided such that an edge corner of a sheet discharged by the sheet discharge member is not trapped in a hole of the punched sheet in a case where the control unit moves the moving member to move the punched sheet in the first direction.

3. The sheet processing apparatus according to claim 1, wherein the control unit moves the moving member to move punched sheets of a predetermined number such that a width-direction center of the punched sheets coincides with a center position in a direction intersecting the sheet discharging direction after the control unit moves the moving member to move the punched sheets of the predetermined number in the first direction.

4. An image forming apparatus comprising:

an image forming unit adapted to form an image on sheets; and the sheet processing apparatus according to claim 1.

5. A sheet processing apparatus comprising:

a sheet discharge member adapted to discharge a sheet;

a sheet-carrying unit adapted to carry the sheet discharged by the sheet discharge member;

a moving member adapted to move the sheet discharged to the sheet-carrying unit in a direction intersecting a sheet discharging direction; and a control unit adapted to control movement of the moving member, wherein based on information that a preceding sheet is a punched sheet in which a hole is formed, the control unit moves the moving member to move the preceding sheet discharged by the sheet discharge member by a predetermined distance in the direction intersecting the sheet discharging direction, and the control unit moves the moving member to move a succeeding sheet discharged after the preceding sheet by the predetermined distance in the direction intersecting the sheet discharging direction.

* * * * *